US006976873B2

(12) United States Patent
Taguchi

(10) Patent No.: US 6,976,873 B2
(45) Date of Patent: Dec. 20, 2005

(54) CONNECTOR

(75) Inventor: Hiroyuki Taguchi, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/855,423

(22) Filed: May 28, 2004

(65) Prior Publication Data

US 2004/0242073 A1 Dec. 2, 2004

(30) Foreign Application Priority Data

May 30, 2003 (JP) ..... 2003-155693

(51) Int. Cl.[7] ..... H01R 9/05
(52) U.S. Cl. ..... 439/578; 439/63; 439/675
(58) Field of Search ..... 439/578–585, 439/63, 675

(56) References Cited

U.S. PATENT DOCUMENTS

| | | | | |
|---|---|---|---|---|
| 4,593,464 | A * | 6/1986 | Williams et al. | 29/879 |
| 4,895,521 | A * | 1/1990 | Grabbe | 439/63 |
| 5,037,328 | A * | 8/1991 | Karlovich | 439/578 |
| 5,183,412 | A * | 2/1993 | Nagafuji | 439/578 |
| 5,580,261 | A * | 12/1996 | Meynier | 439/188 |
| 5,730,621 | A * | 3/1998 | Wang | 439/541.5 |
| 5,807,116 | A * | 9/1998 | Kitatani et al. | 439/63 |
| 6,462,637 | B1 * | 10/2002 | Laverick | 336/107 |
| 6,733,336 | B1 * | 5/2004 | Montena et al. | 439/578 |
| 6,749,464 | B2 * | 6/2004 | Obata | 439/610 |

FOREIGN PATENT DOCUMENTS

| | | | |
|---|---|---|---|
| JP | 05-083025 | A | 4/1993 |
| JP | 05-144526 | A | 6/1993 |
| JP | 05-275914 | A | 10/1993 |
| JP | 06-140105 | A | 5/1994 |
| JP | 06-310337 | A | 11/1994 |
| JP | 09-162617 | A | 6/1997 |
| JP | 09-306603 | A | 11/1997 |
| JP | 09-306603 | A1 | 11/1997 |
| JP | 10-255915 | A | 9/1998 |
| JP | 11-251001 | A | 9/1999 |
| JP | 11-329611 | A | 11/1999 |
| JP | 2001-093622 | A | 4/2001 |

* cited by examiner

*Primary Examiner*—Gary Paumen
(74) *Attorney, Agent, or Firm*—Rader, Fishman & Grauer PLLC

(57) ABSTRACT

A connector having a plug connected to an antenna through a coaxial cable and a receptacle. The plug includes a cylindrical shell, a pin contact, and an insulative pin contact holder provided inside the shell. The receptacle includes a first receptacle housing having a shell-receiving hole and a second receptacle housing provided inside the shell-receiving hole and having a pin contact-receiving hole. A first protrusion is formed in a distal end of the pin contact holder. A first reentrant in which the first protrusion is to be fitted is formed in a distal end of the second receptacle housing. The present invention can prevent the connection of external antennas of other manufacturers to the receptacle because the first protrusion and first reentrant are specified in shape. Also, the plug can be readily connected to the receptacle because the plug can be connected to the receptacle independently of the posture of the plug.

7 Claims, 6 Drawing Sheets

CONNECTOR

CROSS-REFERENCE TO RELATED APPLICATIONS

This application is based upon and claims the benefit of priority from the prior Japanese Patent Application No. 2003-155693 filed on May. 30, 2003, the entire contents of which is incorporated herein by reference.

FIELD OF THE INVENTION

The present invention relates to a connector. More specifically, it relates to a connector for use in a notebook-sized personal computer and connecting to an external antenna for wireless LAN(Local Area Network), for example.

BACKGROUND OF THE INVENTION

Conventionally, portable electronic systems adopting the wireless LAN, such as notebook-sized personal computers (hereinafter referred to as notebook-sized PCs) and Personal Digital Assistants (PDA) have been used at offices, homes, and the like. Such electronic systems allow users to connect to broadband routers from any places by wireless and to access the Internet freely.

An electronic system as described above is provided with, for example, an internal antenna for transmitting and receiving electric waves inside a housing. In addition, the housing is provided with a coaxial connector having a switching function in order to further increase the receiving efficiency thereof. Accordingly, when it is difficult to transmit and receive electric waves through the internal antenna, the coaxial connector is connected to the external antenna to switch from the internal antenna to the external antenna. Therefore, electric waves can be transmitted and received through the external antenna.

Wireless LAN like this is standardized under IEEE 802.11a by Institute of Electrical and Electronic Engineers (IEEE). More specifically, Federal communications commission (FCC) defines that manufacturers shall customize connectors for wireless LAN for electronic systems to transmit and receive electric waves in a frequency range around 5.2 GHz used for high-speed wireless LAN. In other words, it is defined that connectors for antennas shall each have a maker-specific structure so as to prevent any external antennas of other manufacturers from being connected to the connectors.

The above-described definition presented by FCC is not applied to internal antennas, but the FCC definition is applied to connectors to which external antennas are to be connected. Therefore the connectors must be customized.

In order to solve the problem, there has been known a connector having a key and a key groove (see JP-A-9-306603). More specifically, the connector has a plug connected to an external antenna and a receptacle formed with a plug-in opening in which the plug is to be plugged. Here, the plug has the key provided in its distal end, and the receptacle has the key groove provided in the plug-in opening thereof. According to the configuration, the key of the plug is fitted in the key groove of the receptacle, which makes it impossible to connect the other manufacturer's plug to the receptacle. The plug and receptacle can be reliably connected with each other by screwing the coupling cap nut that the plug holds in the external thread formed in the periphery of the receptacle.

However, it is difficult to identify the location of the key groove in a connector as described above when the receptacle is mounted in a place which is difficult for a user to see. Especially, in recent years notebook-sized PCs have been advancing in slimming the housing and accordingly in downsizing the connectors and as such, it has been more difficult to identify the location of the key groove. Therefore, the plug couldn't be connected to the receptacle readily.

Furthermore, when a coaxial cable is connected to the side face of the plug, i.e. when the connector is a so-called right angle connector (and also referred to as an L-shaped connector) in which the direction of the plug plugged in and the extending direction of the coaxial cable intersect at right angles, the posture of the plug is limited by the provision of the key and key groove when the plug is plugged. Accordingly, the connector may not be able to obtain good usability because the extending direction of the coaxial cable is also limited.

The above-described definition by FCC is not limited to the combination of the key and key groove as a maker-specific structure.

SUMMARY OF THE INVENTION

Therefore, in order to solve the above-described problems, an object of the invention is to provide a connector which does not allow any external antennas of other manufacturers to be connected to the receptacle and allows the plug to be readily connected to the receptacle.

In order to achieve the object, configurations as described below are adopted in the invention.

(1) A connector comprising:

a plug connected to an antenna through a coaxial cable; and a receptacle which said plug is to be put in and removed from;

wherein said coaxial cable including an inside conductor extending in its axial direction, and an outside conductor provided outside the inside conductor and extending in its axial direction;

wherein said plug including a cylindrical shell connected to the outside conductor of said coaxial cable, a pin contact connected to the inside conductor of said coaxial cable, and an insulative pin contact holder provided inside the shell for holding the pin contact on a central axis of the shell;

wherein said receptacle including a first receptacle housing having a cylindrical shell-receiving hole in which the shell of said plug is to be plugged, and a second receptacle housing provided inside the shell-receiving hole and having a pin contact-receiving hole in which the pin contact is to be plugged;

wherein a first protrusion is formed in a distal end of the pin contact holder; and wherein a first reentrant in which the first protrusion is to be fitted is formed in a distal end of the second receptacle housing.

The connector may be used for compact systems adopting the wireless LAN. For example, the connector with an external antenna may be used in a high-speed wireless LAN standardized under IEEE 802.11a.

The antenna may be, for example, an external antenna which is provided outside a system in which the connector is mounted. The antenna may be, for example, a wire antenna or a whip antenna. The transmitter-receiver terminal of the antenna are connected to the inside conductor of the coaxial cable, and the ground terminal thereof is connected to the outside conductor of the coaxial cable.

The inside conductor of the coaxial cable may be, for example, a core wire, and may be fixed on the proximal end side of the pin contact by solder. In addition, the outside conductor of the coaxial cable may be, for example, a braided wire and may be pinched on the proximal end side of the cylindrical shell thereby to be fixed.

The connecting portion of the plug and coaxial cable may be covered with an insulating protective cover. In this case, the protective cover may be grasped thereby to put the plug in the receptacle and remove the plug from the receptacle.

Grooved notches may be formed on its distal end side and proximal end side of the periphery of the pin contact holder respectively. The grooved notches may be engaged to the cylindrical shell to hold the pin contact holder in the cylindrical shell.

Inside the second receptacle housing, a fixed contact and an elastically-deformable and movable contact urged toward the fixed contact maybe provided. In this case, the pin contact is inserted in the pin contact-receiving hole. Thus, the distal end of the pin contact enters between the movable contact and the fixed contact and presses the movable contact to separate the movable contact from the fixed contact. In contrast, when the pin contact is withdrawn from the pin contact-receiving hole, the movable contact abuts the fixed contact thereby to be electrically connected to the fixed contact. Accordingly, the receptacle has a switching function.

In addition, the receptacle may be disposed on a printed wiring board and fixed to a ground pattern on the board by solder.

According to the invention of (1), the first protrusion of the pin contact holder is fitted in the first reentrant of the second receptacle housing, thereby to connect the plug to the receptacle. Thus, the first protrusion and the first reentrant are specified in shape so that the connector can prevent any external antennas of other manufacturers from being connected to the receptacle.

In addition, the plug can be connected to the receptacle independently of the posture of the plug because it is not required to combine a key and a key groove like conventional cases. On this account, the plug can be readily connected to the receptacle.

(2) A connector comprising:

a plug connected to an antenna through a coaxial cable; and a receptacle which said plug is to be put in and removed from;

wherein said coaxial cable including an inside conductor extending in its axial direction, and an outside conductor provided outside the inside conductor and extending in its axial direction;

wherein said plug including a cylindrical shell connected to the outside conductor of said coaxial cable, a pin contact connected to the inside conductor of said coaxial cable, and an insulative pin contact holder provided inside the shell for holding the pin contact on a central axis of the shell;

wherein said receptacle including a first receptacle housing having a cylindrical shell-receiving hole in which the shell of said plug is to be plugged, and a second receptacle housing provided inside the shell-receiving hole and having a pin contact-receiving hole in which the pin contact is to be plugged;

wherein a first reentrant formed in a distal end of the pin contact holder; and wherein a first protrusion which the first reentrant is to be fitted in is formed in a distal end of the second receptacle housing.

The connector may be used for compact systems adopting the wireless LAN. For example, the connector with an external antenna may be used in a high-speed wireless LAN standardized under IEEE 802.11a.

The antenna may be, for example, an external antenna which is provided outside a system with the connector mounted therein. The antenna may be, for example, a wire antenna or a whip antenna. The transmitter-receiver terminal of the antenna are connected to the inside conductor of the coaxial cable, and the ground terminal thereof is connected to the outside conductor of the coaxial cable.

The inside conductor of the coaxial cable may be, for example, a core wire, and may be fixed on the proximal end side of the pin contact by solder. In addition, the outside conductor of the coaxial cable may be, for example, a braided wire and may be pinched on the proximal end side of the cylindrical shell thereby to be fixed.

The connecting portion of the plug and coaxial cable may be covered with an insulating protective cover. In this case, the protective cover may be grasped thereby to put the plug in the receptacle and remove the plug from the receptacle.

Grooved notches may be formed on its distal end side and proximal end side of the periphery of the pin contact holder respectively. The grooved notches may be engaged to the cylindrical shell to hold the pin contact holder in the cylindrical shell.

Inside the second receptacle housing, a fixed contact and an elastically-deformable and movable contact urged toward the fixed contact may be provided. In this case, the pin contact is inserted in the pin contact-receiving hole. Thus, the distal end of the pin contact enters between the movable contact and the fixed contact and presses the movable contact to separate the movable contact from the fixed contact. In contrast, when the pin contact is withdrawn from the pin contact-receiving hole, the movable contact abuts the fixed contact thereby to be electrically connected to the fixed contact. Accordingly, the receptacle has a switching function.

In addition, the receptacle may be disposed on a printed wiring board and fixed to a ground pattern on the board by solder.

According to the invention of (2), the first reentrant of the pin contact holder is fitted in the first protrusion of the second receptacle housing, thereby to connect the plug to the receptacle. Thus, the first protrusion and the first reentrant are specified in shape so that the connector can prevent any external antennas of other manufacturers from being connected to the receptacle.

In addition, the plug can be connected to the receptacle independently of the posture of the plug because it is not required to combine a key and a key groove like conventional cases. On this account, the plug can be readily connected to the receptacle.

(3) The connector according to (1) or (2), wherein said receptacle includes elastically-deformable first pressing pieces protruded from an inner surface of the shell-receiving hole of the first receptacle housing, wherein an annular groove portion is formed in an outer peripheral surface of the shell of said plug, and whereby the first pressing pieces of said receptacle are elastically deformed and engaged with a groove portion of said plug when said plug is plugged in said receptacle.

According to the invention of (3), the connector has a half-lock structure to hold the plug in the receptacle by engaging the first pressing pieces with the annular groove portion. Therefore, the plug can be inserted in and drawn from the receptacle readily.

(4) The connector according to (3), where in the second receptacle housing is sandwiched between the first pressing pieces.

According to the invention of (4), the plug can be held by the receptacle more reliably because the first pressing pieces are disposed so as to sandwich the second receptacle housing.

(5) The connector according to (4), wherein said receptacle includes second pressing pieces protruded from an outer peripheral surface of the second receptacle housing, and whereby the second pressing pieces of said receptacle are elastically deformed to steady the shell of said plug from its inside when said plug is plugged in said receptacle.

(6) The connector according to any one of (1) to (5), wherein said receptacle includes a fixed contact and an elastically-deformable elastic contact abutting the fixed contact, and whereby the pin contact penetrates through the pin contact-receiving hole and presses the elastic contact to separate the elastic contact from the fixed contact when the pin contact is plugged in the pin contact-receiving hole.

(7) The connector according to any one of (1) to (6), wherein said plug is connected to an external antenna for wireless LAN.

(8) The connector according to any one of (1) to (6), wherein said plug is connected to an external antenna for high-speed wireless LAN standardized under IEEE 802.11a.

DETAILED DESCRIPTION OF THE PREFERRED EMBODIMENT

The embodiments of the invention will be described below in reference to the drawings. In the description below on the embodiments, the same components are indicated by the same symbols and the description thereof is omitted or simplified.

First Embodiment

Figure 1:
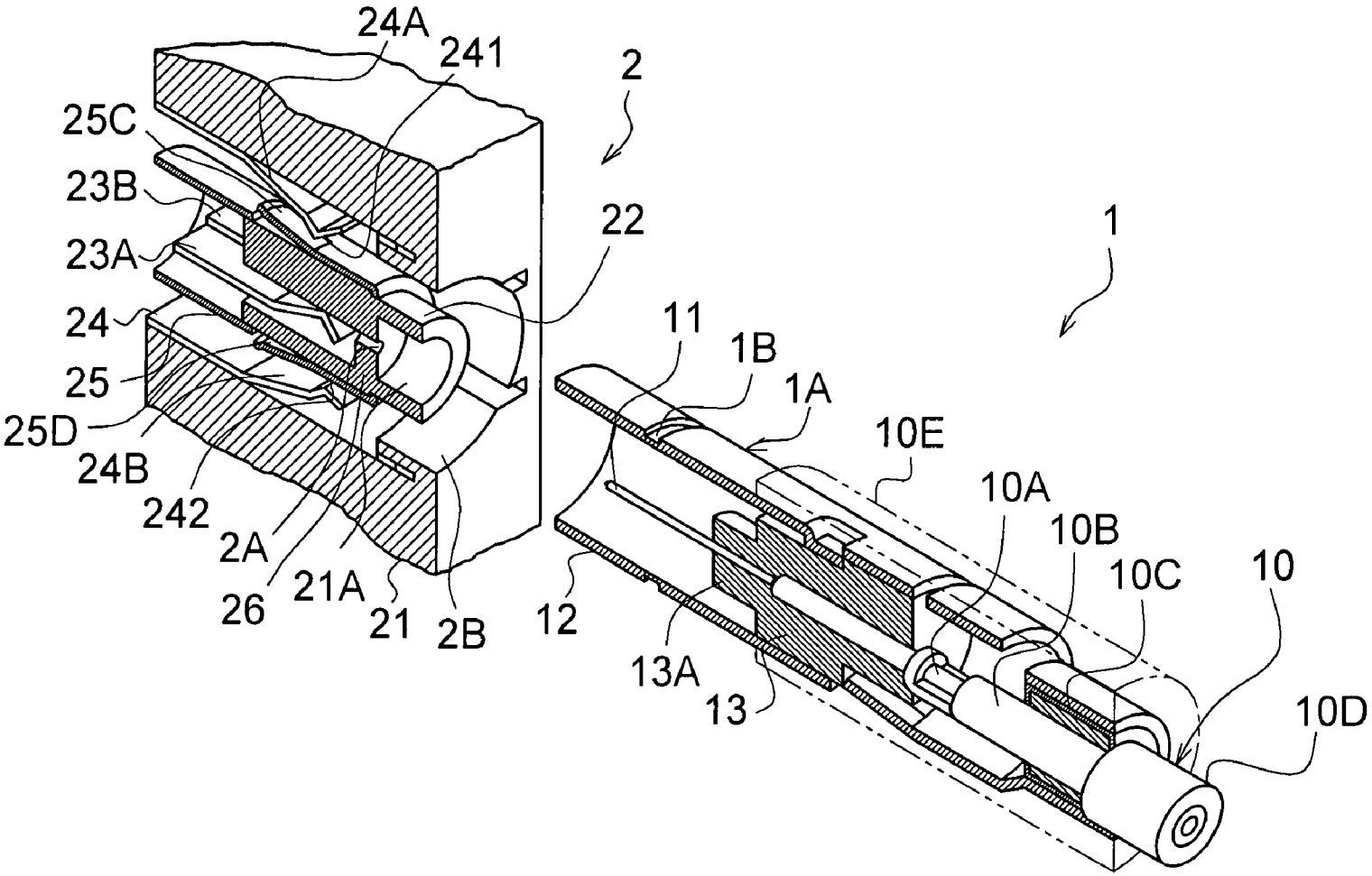
FIG. 1 is a perspective sectional view showing a connector according to a first embodiment of the present invention.

FIG. 1 is a perspective sectional view of a connector according to a first embodiment of the invention.

The connector has a plug 1 connected to an antenna through a coaxial cable 10, and a rectangular parallelepiped receptacle 2 which the plug 1 is to be put in and removed from.

The receptacle 2 is mounted on a side face of a notebook-sized PC (not shown), and the plug 1 is connected to an antenna for high-speed wireless LAN standardized under IEEE 802.11a. When the plug 1 is connected to the receptacle 2, the connector can transmit and receive radio waves with an external antenna.

The coaxial cable 10 includes: a core wire 10A as an inside conductor extending in its axial direction; an insulator 10B for covering the core wire 10A, which is formed from polyethylene or the like; a braided wire 10C as an outside conductor provided outside the insulator 10B and extending in its axial direction; and an insulator 10D for covering the braided wire 10C.

Figure 2A:
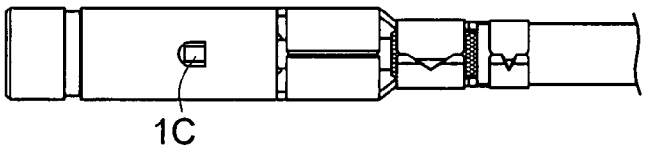
FIG. 2A is atop view of a plug according to the embodiment.
Figure 2B:
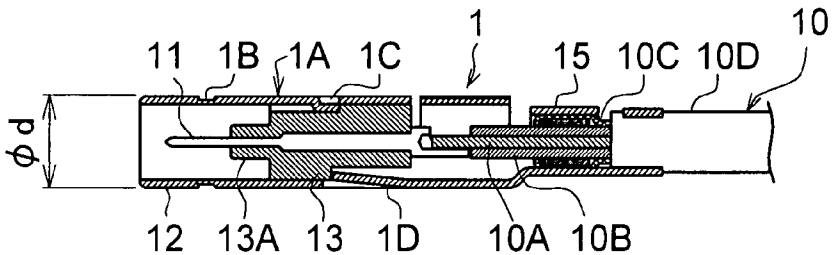
FIG. 2B is a longitudinal sectional view of the plug according to the embodiment.
Figure 2C:
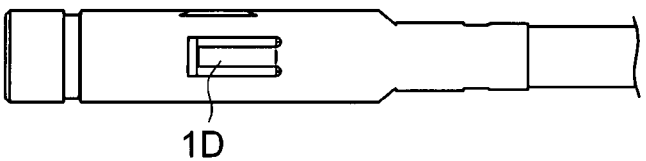
FIG. 2C is a bottom view of the plug according to the embodiment.

FIG. 2A is a top view of the plug 1, FIG. 2B is a longitudinal sectional view of the plug 1, and FIG. 2C is a bottom view of the plug 1.

The plug 1 includes: a cylindrical shell 12 having an outer diameter d connected to the coaxial cable 10; a pin contact 11 connected to the core wire 10A of the coaxial cable 10; and an insulative pin contact holder 13 provided inside the shell 12 for keeping the pin contact 11 on the central axis of the shell 12. In other words, the shell 12 and pin contact 11 are disposed concentrically.

The pin contact 11 has a columnar form with a small outer diameter on the side of a distal end thereof, and a columnar form with a large outer diameter on a proximal end side thereof. More specifically, a step is formed between the distal end and proximal end of the pin contact 11.

Furthermore, the distal end of the pin contact 11 is shaped into a conical form. The pin contact 11 has an arc-shape groove formed on the proximal end side, and the core wire 10A of the coaxial cable 10 is fixed in the groove by solder.

A through-hole into which the pin contact 11 is inserted is formed in the pin contact holder 13. The through-hole has a large inner diameter on the side of a distal end thereof and a small inner diameter on a proximal end side thereof. More specifically, a step is formed between the distal end and proximal end of the through-hole. When the pin contact 11 is inserted into the through-hole of the pin contact from the proximal end side of the through-hole of the pin contact holder 13, the step of the pin contact 11 engages the step of the through-hole, whereby the pin contact is held there.

The pin contact holder 13 has a columnar first protrusion 13A formed on its distal end surface.

The shell 12 has an annular groove portion 1B formed in the outer peripheral surface thereof on the side of the distal end of the shell.

The shell 12 has notches formed in positions opposed to each other nearly in the middle of the outer peripheral surface of the shell 12. One of the notches is a protruding piece 1C protruding toward the inside of the shell, and the other is a bendable bending piece 1D. Therefore, the pin contact holder 13 is inserted into the shell 12 from the proximal end side of the shell until the holder 13 abuts the protruding piece 1C. Then by bending the bending piece 1D inwardly, the bending piece 1D engages the pin contact holder 13. The pin contact holder 13 is thus held by the shell 12.

Also, the coaxial cable 10 is inserted into the shell 12 on the proximal end side of the shell. On the side of a distal end of the coaxial cable 10, the insulator 10D is peeled off so that the braided wire 10C is exposed. In a distal end portion of the portion where the braided wire 10C is exposed, the braided wire 10C and the insulator 10D are peeled off and thus the core wire 10A is exposed.

The exposed portion of the core wire 10A is fixed on the proximal end side of the pin contact 11. Further, an insulative tube ferrule 15 is mounted between the exposed portions of the braided wire 10C and insulator 10B. The exposed portion of the braided wire 10C is clamped on the proximal end side of the shell 12. Therefore, the exposed portion of the braided wire 10C is pinched on the proximal end side of the cylindrical shell 12 and electrically connected to the shell 12.

The connecting portion of the plug 1 and coaxial cable 10 is covered by a boot 10E as an insulating protective cover. Therefore, the plug 1 is put in and removed from the receptacle 2 by grasping the boot 10E.

Figure 2D:
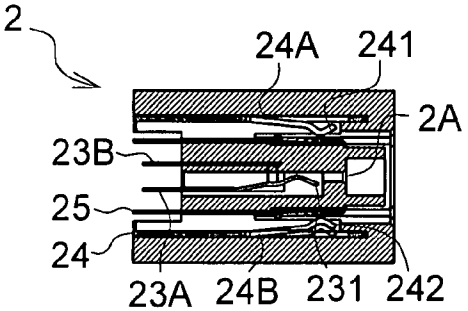
FIG. 2D is a transverse sectional view of a receptacle according to the embodiment.
Figure 2E:
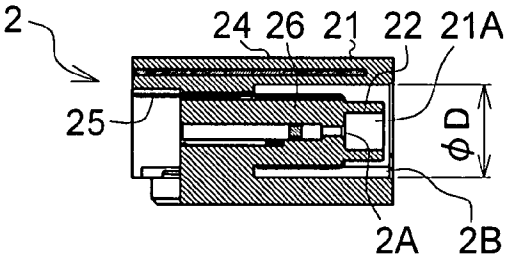
FIG. 2E is a longitudinal sectional view of the receptacle according to the embodiment.

FIG. 2D is a transverse sectional view of the receptacle 2, and FIG. 2E is a longitudinal sectional view of the receptacle 2.

The receptacle 2 includes: a first receptacle housing 21 having a shell-receiving hole 2B into which the shell 12 of the plug 1 is inserted; and a second receptacle housing 26 which is provided inside the shell-receiving hole 2B and has a pin contact-receiving hole 2A into which the pin contact 11 is inserted.

The shell-receiving hole 2B of the first receptacle housing 21 has an inner diameter D which is slightly larger than the outer diameter d of the shell 12. An annular groove is formed between the shell-receiving hole 2B and the pin contact-receiving portion 22. The annular groove and the pin contact-receiving hole 2A are formed on concentric circles.

A first ground shell 24 extending along its axial direction is provided in the inner surface of the shell-receiving hole 2B.

The second receptacle housing 26 includes: a cylindrical second ground shell 25 extending along the axial direction of the shell-receiving hole 2B; and the pin contact-receiving portion 22 provided in the distal end of the second ground shell 25 and having the pin contact-receiving hole 2A.

A first reentrant 21A in which the first protrusion 13A is to be fitted is formed in the distal end surface of the pin contact-receiving portion 22. The pin contact-receiving hole 2A is formed in the center of the first reentrant 21A.

Elastically-deformable second pressing pieces 25C, 25D which protrude outwardly are provided on the second ground shell 25.

Inside the second ground shell 25, there are provided a fixed contact 23B extending along the axial direction of the second ground shell 25, and an elastically-deformable and movable contact 23A urged toward the fixed contact 23B.

Figure 3:
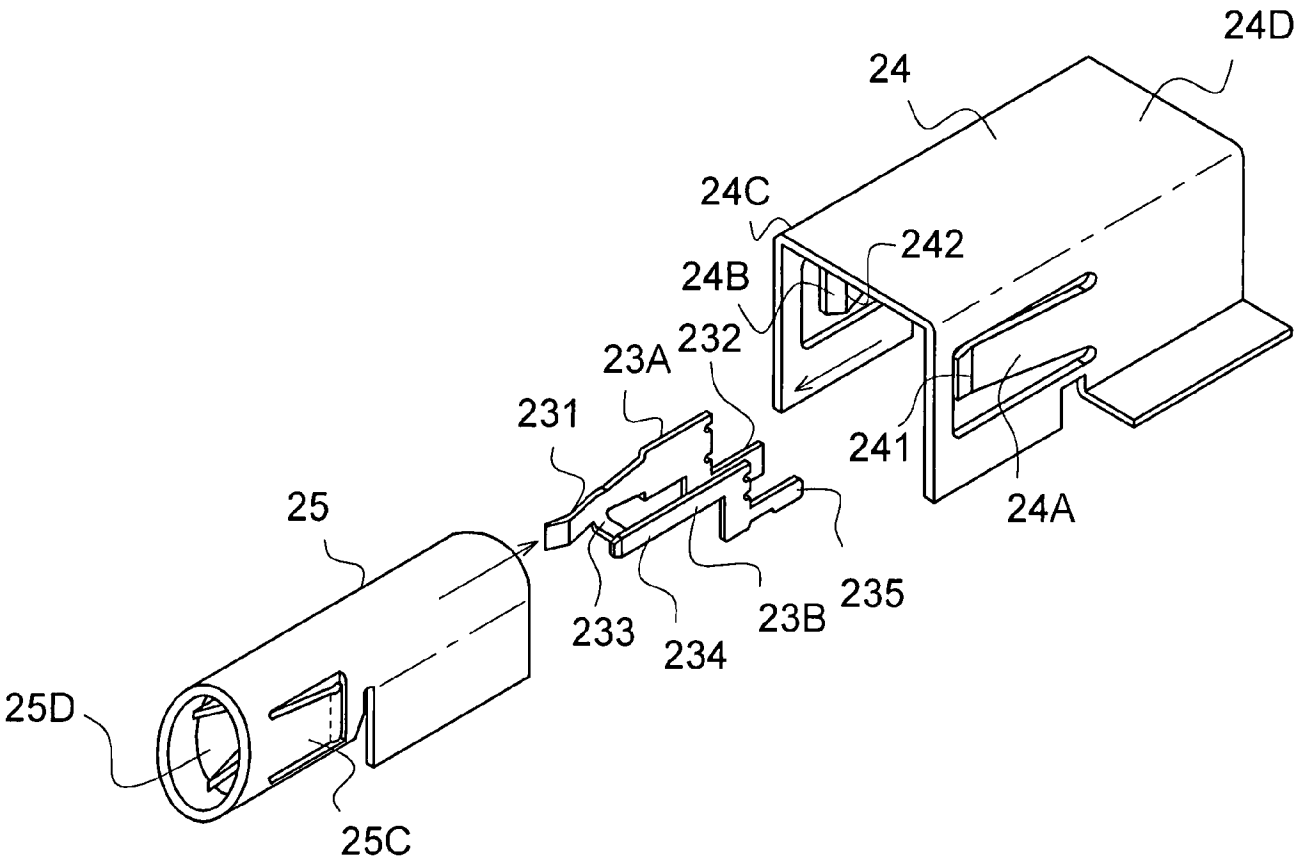
FIG. 3 is an exploded perspective view of main parts constituting the receptacle according to the embodiment.

FIG. 3 is an exploded perspective view of the first ground shell 24, second ground shell 25, fixed contact 23B, and movable contact 23A, which constitute the receptacle 2.

The fixed contact 23B is shaped like a plate, and includes a proximal end portion 235 fixed on a printed wiring board (not shown) by solder or the like and a distal end portion 234 which a bending piece 233 of the movable contact to be described later abuts.

The movable contact 23A is formed from a leaf spring, and includes a proximal end portion 232 fixed on the printed wiring board (not shown) by solder or the like and a distal end portion 231 curved so that it becomes closer to the fixed contact 23B towards the distal end thereof.

The distal end portion 231 of the movable contact 23A is located on the route which the pin contact 11 is passed through. A portion near the distal end of the distal end portion 231 is bent toward the fixed contact 23B and therefore it is a bending piece 233 abutting the fixed contact 23B.

The second ground shell 25 is conductive and has a cylindrical form on the side of its distal end portion and a U-shaped form in cross section on the proximal end side thereof. On the distal end side of the second ground shell 25, there is provided one pair of second pressing pieces 25C, 25D disposed opposed to each other The second pressing pieces 25C, 25D are elastically deformable and extending toward the outside of the second ground shell 25. The second ground shell 25 is fixed to the printed wiring board (not shown) by solder or the like on the proximal end side and grounded.

The above-described first ground shell 24 is conductive and has a U-shaped form in cross section. The first ground shell 24 has a flange (brim) formed on the proximal end side. The flange is fixed to the printed wiring board (not shown) by solder or the like and grounded.

Also, on the first ground shell 24 there is a pair of elastically-deformable first pressing pieces 24A, 24B by which the second receptacle housing 26 is sandwiched. The first pressing pieces 24A, 24B are curved at curved portions 241, 242. The curved portions 241, 242 are stuck out inwardly (see FIG. 2).

The movable contact 23A, fixed contact 23B, second ground shell 25, and first ground shell 24 are press-fitted into the first receptacle housing 2l and integrated. More specifically, the movable contact 23A and the fixed contact 23B are press-fitted into the second ground shell 25 from the proximal end side, and the second ground shell 25 is press-fitted into the first ground shell 24 from the side of the distal end.

Figure 4:
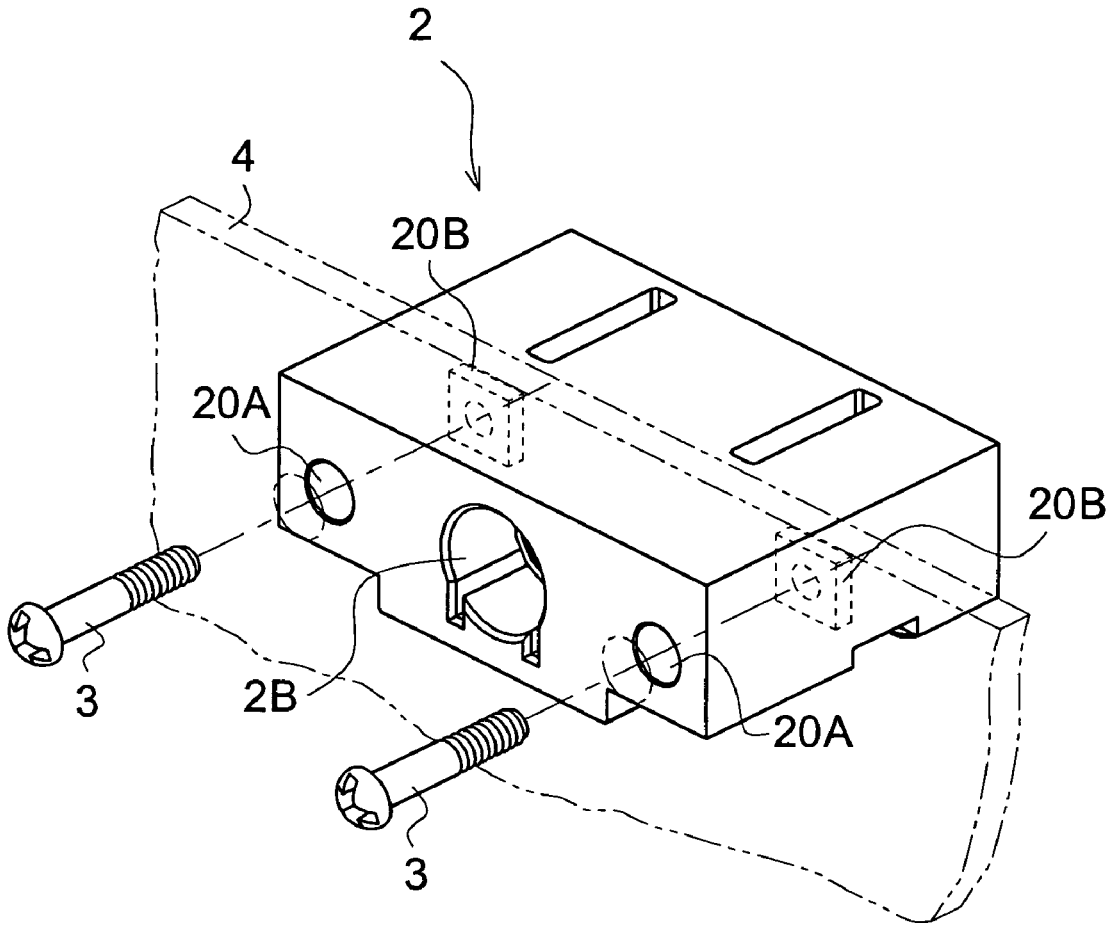
FIG. 4 is a perspective view of the appearance of the receptacle according to the embodiment.

FIG. 4 is a perspective view of the appearance of the receptacle 2.

The first receptacle housing 21 of the receptacle 2 has two through-holes 20A formed on both sides of the shell-receiving hole 2B. Further, inside the first receptacle housing 21, there are provided square nuts 20B. The receptacle 2 is fixed to a side panel 4 of a PC by inserting screws 3 as fastening means into the respective through-holes 20A and screwing the screws 3 in the respective square nuts 20B.

Now, the procedure of connecting the plug 1 to the receptacle 2 will be described.

First, the distal end of the shell 12 of the plug 1 is aligned with the shell-receiving hole 2B of the receptacle 2 and the plug 1 is inserted into the receptacle 2. Then, the pin contact 11 of the plug 1 is guided into the pin contact-receiving hole 2A of the receptacle 2. When the plug 1 is further inserted continually, the first protrusion 13A of the pin contact holder 13 is fitted in the first reentrant 21A of the pin contact-receiving portion 22. The plug 1 is thus connected to the receptacle 2.

Further, the curved portions 241, 242 of the first pressing pieces 24A, 24B of the receptacle 2 are elastically deformed and engaged with the groove portion of the plug 1. Concurrently, the second pressing pieces 25C, 25D of the receptacle 2 are elastically deformed to steady the shell 12 of the plug 1 from the inside.

Also, the pin contact 11 is inserted into the pin contact-receiving hole 2A. Thus, the distal end of the pin contact 11 enters between the movable contact 23A and the fixed contact 23B and presses the movable contact 23A to separate the movable contact from the fixed contact 23B. In contrast, when the pin contact 11 is withdrawn from the pin contact-receiving hole 2A, the movable contact 23A abuts the fixed contact 23B thereby to be electrically connected to the fixed contact. Accordingly, the receptacle has a switching function.

Thus, the first protrusion 13A and the first reentrant 21A are specified in shape so that the connector can prevent any external antennas of other manufacturers from being connected to the receptacle.

In addition, the plug 1 can be connected to the receptacle 2 independently of the posture of the plug 1 because it is not required to combine a key and key groove like conventional cases. On this account, the plug can be readily connected to the receptacle.

Grooved notches are formed on distal end side and proximal end side of the periphery of the pin contact holder respectively. The grooved notches are engaged to the cylindrical shell to hold the pin contact holder in the cylindrical shell.

Second Embodiment

The embodiment is different from the first embodiment in the configurations of the pin contact holder 14 and pin contact-receiving portion 22.

Figure 5:
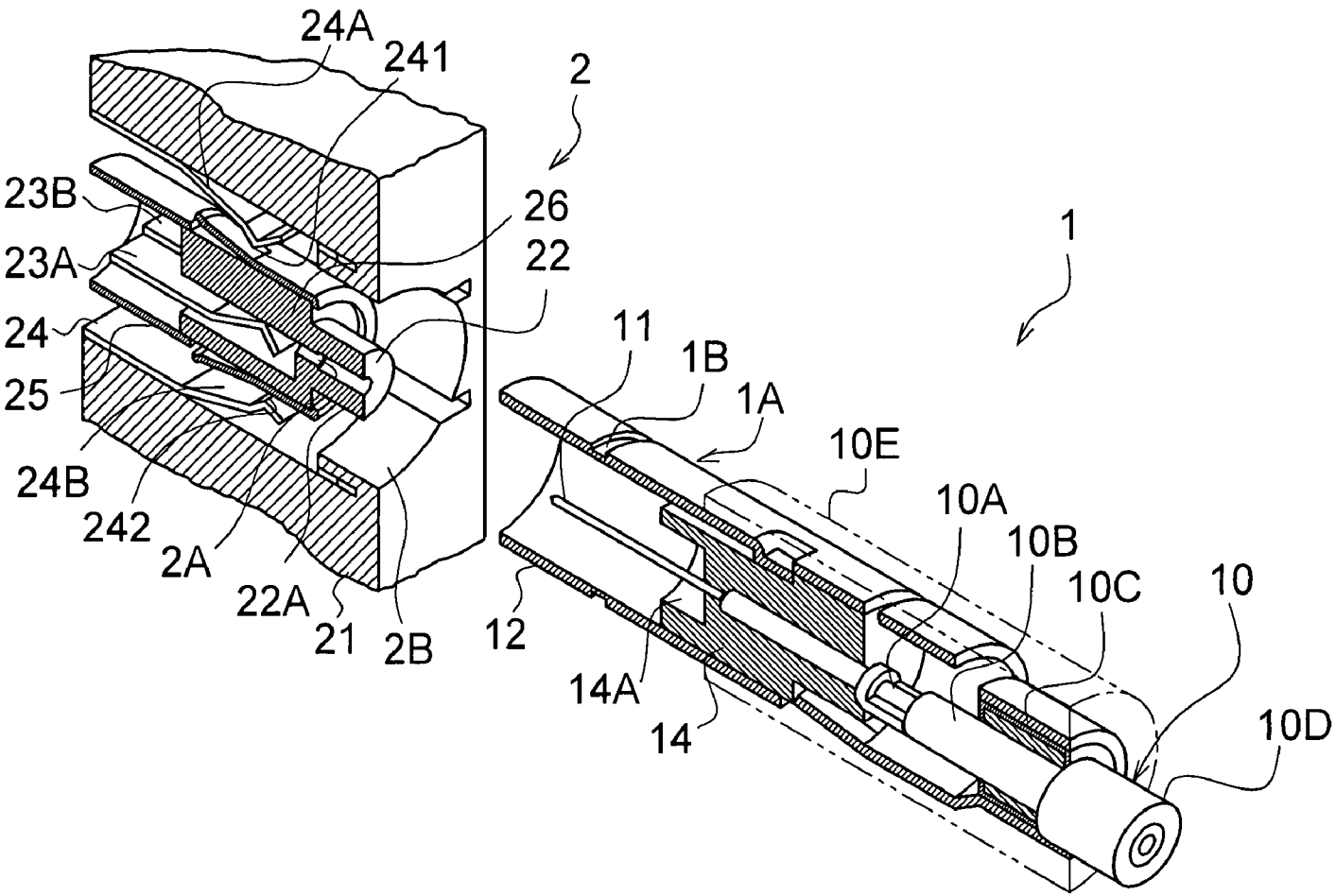
FIG. 5 is a perspective sectional view showing a connector according to a second embodiment of the present invention.

FIG. 5 is a perspective sectional view showing a connector according to the second embodiment of the invention.

Figure 6A:
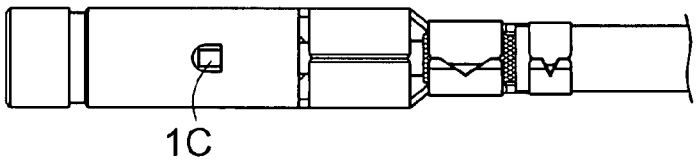
FIG. 6A is a top view of a plug according to the embodiment.
Figure 6B:
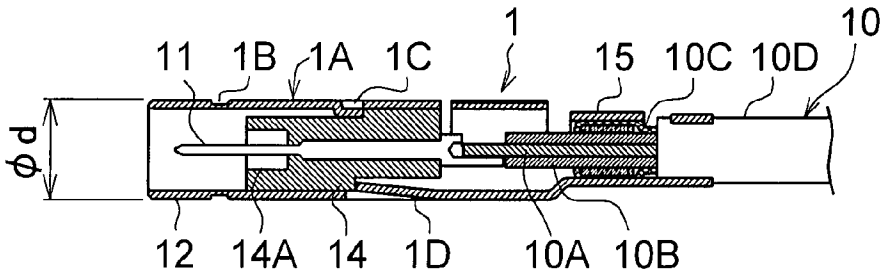
FIG. 6B is a longitudinal sectional view of the plug according to the embodiment.
Figure 6C:
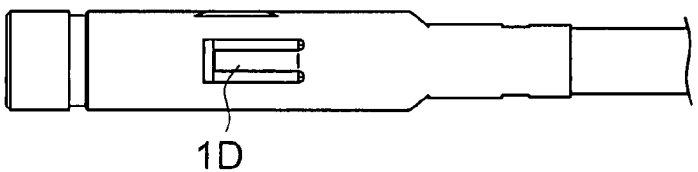
FIG. 6C is a bottom view of the plug according to the embodiment.
Figure 6D:
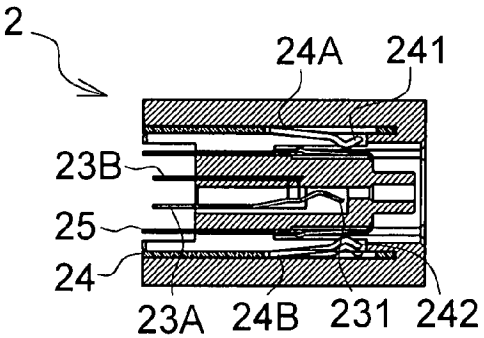
FIG. 6D is a transverse sectional view of a receptacle according to the embodiment.
Figure 6E:
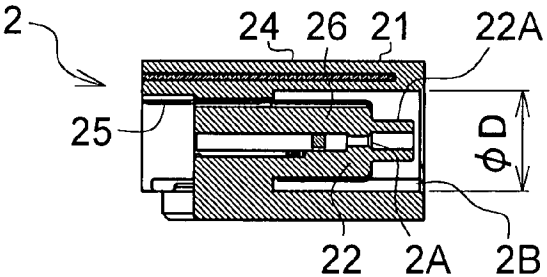
FIG. 6E is a longitudinal sectional view of the receptacle according to the embodiment.

FIG. 6A is a top view of the plug 1, FIG. 6B is a longitudinal sectional view of the plug 1, and FIG. 6C is a bottom view of the plug 1. FIG. 6D is a transverse sectional view of the receptacle 2, and FIG. 6E is a longitudinal sectional view of the receptacle 2.

In the distal end surface of the pin contact-receiving portion 22, there is formed a columnar second protrusion 22A. The pin contact-receiving hole 2A is located in the center of the second protrusion 22A.

In the distal end surface of the pin contact holder 14, there is formed a second reentrant 14A in which the second protrusion 22A is to be fitted.

Now, the procedure of connecting the plug 1 to the receptacle 2 will be described.

The second reentrant 14A of the pin contact holder 14 is fitted to the second protrusion 22A of the pin contact-receiving portion 22. Therefore, the plug 1 is connected to the receptacle 2. Thus, the second reentrant 14A and the second protrusion 22A are specified in shape so that the connector can prevent any external antennas of other manufacturers from being connected to the receptacle 2.

The invention is not limited the above-described embodiments, and it includes the modifications and improvements which are made within a scope such that the object of the invention can be achieved.

For example, the connector of the present invention may have the function of wireless LAN and may be used for a notebook-sized PC or a PDA capable of switching between its external antenna and internal antenna.

The connector of the present invention can provide the following advantages.

The first protrusion of the pin contact holder is fitted in the first reentrant of the second receptacle housing, thereby to connect the plug to the receptacle. Thus, the first protrusion and the first reentrant are specified in shape so that the connector can prevent any external antennas of other manufacturers from being connected to the receptacle.

In addition, the plug can be connected to the receptacle independently of the posture of the plug because it is not required to combine a key and a key groove like conventional cases. On this account, the plug can be readily connected to the receptacle.

What is claimed is:

1. A connector comprising:

a plug connected to an antenna through a coaxial cable; and a receptacle that receives said plug;

wherein said coaxial cable includes an inside conductor extending in an axial direction, and an outside conductor provided outside the inside conductor and extending in the axial direction;

wherein said plug includes a cylindrical shell connected to the outside conductor of said coaxial cable, a pin contact connected to the inside conductor of said coaxial cable, and an insulative pin contact holder provided inside the cylindrical shell for holding the pin contact on a central axis of the cylindrical shell;

wherein said receptacle includes a first receptacle housing having a cylindrical shell-receiving hole in which the cylindrical shell of said plug is inserted, and a second receptacle housing provided inside the cylindrical shell-receiving hole, the second receptacle housing having a pin contact-receiving hole into which the pin contact is inserted;

wherein a first protrusion is in a distal end of the pin contact holder; and wherein a first reentrant in which the first protrusion is to be fitted is in a distal end of the second receptacle housing, wherein said receptacle includes elastically-deformable first pressing pieces that protrude from an inner surface of the cylindrical shell-receiving hole of the first receptacle housing, wherein an annular groove portion is formed in an outer peripheral surface of the cylindrical shell of said plug, and whereby the first pressing pieces of said receptacle are elastically deformed and engaged with a groove portion of said plug when said plug is inserted into said receptacle.

2. A connector comprising:

a plug connected to an antenna through a coaxial cable; and a receptacle that receives said plug;

wherein said coaxial cable includes an inside conductor that extends in an axial direction, and an outside conductor provided outside the inside conductor, the outside conductor extending in the axial direction;

wherein said plug includes a cylindrical shell connected to the outside conductor of said coaxial cable, a pin contact connected to the inside conductor of said coaxial cable, and an insulative pin contact holder provided inside the cylindrical shell for holding the pin contact on a central axis of the cylindrical shell;

wherein said receptacle includes a first receptacle housing having a cylindrical shell-receiving hole into which the cylindrical shell of said plug is inserted, and a second receptacle housing provided inside the cylindrical shell-receiving hole and having a pin contact-receiving hole into which the pin contact is inserted;

wherein a first reentrant is in a distal end of the pin contact holder; and wherein a first protrusion into which the first reentrant is fitted is in a distal end of the second receptacle housing, wherein said receptacle includes elastically-deformable first pressing pieces that protrude from an inner surface of the cylindrical shell-receiving hole of the first receptacle housing, wherein an annular groove portion is formed in an outer peripheral surface of the cylindrical shell of said plug, and whereby the first pressing pieces of said receptacle are elastically deformed and engaged with a groove portion of said plug when said plug is inserted into said receptacle.

3. The connector according to claim 1 or 2, wherein the second receptacle housing is between the first pressing pieces.

4. The connector according to claim 3, wherein said receptacle includes second pressing pieces that protrude from an outer peripheral surface of the second receptacle housing, and whereby the second pressing pieces of said receptacle are elastically deformed to steady the cylindrical shell of said plug from the inner surface when said plug is inserted into said receptacle.

5. The connector according to claim 1 or 2, wherein said receptacle includes a fixed contact and an elastically-deformable elastic contact abutting the fixed contact, and whereby the pin contact penetrates through the pin contact-receiving hole and presses the elastic contact to separate the elastic contact from the fixed contact when the pin contact is inserted into the pin contact-receiving hole.

6. The connector according to claim 1 or 2, wherein said plug is connected to an external antenna for wireless LAN.

7. The connector according to claim 1 or 2, wherein said plug is connected to an external antenna for high-speed wireless LAN standardized under IEEE 802.11a.

* * * * *